US005906146A

United States Patent [19]

Arlen

[11] Patent Number: 5,906,146

[45] Date of Patent: May 25, 1999

[54] APPARATUS AND METHOD FOR EXTRACTING BROKEN THREADED MEMBERS

[75] Inventor: Gary D. Arlen, Boise, Id.

[73] Assignee: Micron Technology, Inc., Boise, Id.

[21] Appl. No.: 08/916,112

[22] Filed: Aug. 21, 1997

[51] Int. Cl.[6] ..... B25B 13/48

[52] U.S. Cl. ..... 81/53.2; 81/436

[58] Field of Search ..... 81/53.2, 441, 459, 81/436, 437, 439; 29/426.4

[56] References Cited

U.S. PATENT DOCUMENTS

| | | | |
|---|---|---|---|
| 2,912,890 | 11/1959 | Robinson | 81/53.2 |
| 3,463,209 | 8/1969 | Podolsky | 81/436 |
| 3,888,144 | 6/1975 | Parsons | 81/436 |
| 4,380,942 | 4/1983 | Fenton | 81/436 |
| 4,604,917 | 8/1986 | Polonsky . | |
| 4,777,850 | 10/1988 | Polonsky . | |
| 4,831,902 | 5/1989 | McClure . | |
| 4,955,936 | 9/1990 | Douglas | 81/441 |
| 5,031,487 | 7/1991 | Polonsky . | |
| 5,251,516 | 10/1993 | Desaulniers . | |
| 5,279,187 | 1/1994 | Salmon . | |
| 5,513,545 | 5/1996 | George | 81/53.2 |

FOREIGN PATENT DOCUMENTS

| | | | |
|---|---|---|---|
| 2019284 | 10/1979 | United Kingdom | 81/53.2 |

*Primary Examiner*—D. S. Mei slin
*Attorney, Agent, or Firm*—Kirkpatrick & Lockhart LLP

[57] ABSTRACT

Apparatuses and methods are disclosed for extracting broken members, such as bolt and threaded fasteners, from tapped holes. The apparatus includes a shaft having a plurality of stepped regions and at least one engagement edge extending along the shaft. The apparatus further includes a drive portion suitable for mating with a driver, such as a wrench or power tools, to apply torque to and rotate the apparatus around an axis passing through the stepped regions of the shaft. Preferably, the apparatus includes four stepped regions of decreasing cross-sectional dimensions. The two largest cross-sectional regions define the drive portion that is engaged by the driver. The two smaller cross-sectional regions, or engagement regions, define an engagement portion. The cross-sections of the engagement regions are substantially square and defined by four substantially parallel engagement edges extending over the length of the engagement regions parallel to the rotational axis. In the use of invention to remove a member having a broken end from a tapped hole, a bore is produced in the member having a plurality of cross-sectional dimensions are less than at least one cross-sectional dimension of a corresponding region on the apparatus. The apparatus is inserted into the bore so that at least one engagement edge on the apparatus cuts into the member in the plurality of bore cross-sections. The driver is used to apply torque to the apparatus that is transmitted to and unthreads the member from the tapped hole.

31 Claims, 3 Drawing Sheets

APPARATUS AND METHOD FOR EXTRACTING BROKEN THREADED MEMBERS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention is directed generally to removing broken threaded members, such as bolts or other fasteners, from a body. More particularly, the invention is directed to removing broken threaded environmental sensor bodies from equipment, such as a thermocouple from a heat exchanger.

Often a head of a threaded fastener, such as bolt, will break off of a shaft of the fastener while the fastener is threaded in a tapped mated hole in a piece of equipment. The removal of the shaft remaining in the hole is a difficult process that often results in damage to the equipment. Generally, a bore must be drilled in the shaft of the broken fastener to provide access for a removal tool.

The most commonly used tool for removing the fastener shafts is known as an "easy-out". The easy-out is a cylindrical tool that is tapered to provide a continuous decreasing cross-section from a drive head to an insertion end of the tool. The tool body has edges or fluted threads running in a direction opposite to the thread direction in the tapped hole. When the tool is inserted in the bore, the edges or threads engage the bore walls near the broken edge of the fastener. A force is applied to the drive head to remove the fastener from the tapped hole. The tapered design of the easy-out allows for its use with a wide range of bore sizes.

U.S. Pat. Nos. 4,604,917, 4,777,850 and 5,031,487issued to Polonsky disclose combination drill bit/removal tool devices that provide for drilling the bore in the shaft, inserting a removal tool and extracting the broken fastener in a stepwise continuous process. The removal tool portion is a tapered device that engages the bore wall at the broken edge of the shaft, similar to the easy-out tools. A difficulty with the easy-out tools and the combination tools of Polonsky is that the tapered shape of the tools provides for a very small contact area with the bore wall at the broken end of the shaft. Therefore, the torque required to loosen the entire fastener must be translated through the very small contact area. As might be expected, the concentrated application of torque to the small area often causes the fastener material to yield and the tool strips the bore, or the easy-out itself breaks off in the bore. As a result, it may take several iterations before the fastener is removed, or, worse yet, the removal attempt may be unsuccessful.

Recognizing the aforementioned difficulties, U.S. Pat. Nos. 4,831,902 (the "'902 patent") and 5,279,187 (the "'187 patent") provide broken fastener removal devices that provide extended contact areas between the removal tool and the shaft of the fastener. The '902 patent discloses the use of a plurality of bore holes drilled in the shaft to attach a removal tool. A corresponding number of alignment pins are inserted into the bore holes and connected to a drive head that is used to remove the fastener. In the '902 patent embodiments, a substantial shearing force is exerted upon the alignment pins at the broken end of the shaft. Therefore, the pins must have sufficient strength to withstand the shearing force at the edge of the shaft, while being of a small enough dimension that a plurality of the pins can be inserted in the shaft. Also, these devices cannot be easily adapted for use in removing tubular fasteners, such as sensor bodies.

The '187 patent provides an expandable jaw removal tool for use in removing broken fasteners. The expandable jaw is inserted into a previously drilled bore in the shaft. The jaws are expanded to contact the bore wall and translate an applied torque to remove the fastener. The invention of the '187 patent provides a viable option for removing broken fasteners. However, it may be difficult to remove fasteners that are not only broken, but mechanically frozen in the tapped hole using the techniques of the '187 patent.

In view of these and other difficulties with prior art removal tools and methods, there is a need for more versatile tools and methods for removing broken threaded members from tapped holes.

BRIEF SUMMARY OF THE INVENTION

The above difficulties are addressed by methods and apparatuses in accordance with the present invention. The apparatus includes a shaft having a plurality of stepped regions and at least one engagement edge extending along the shaft. The apparatus further includes a drive portion suitable for mating with a driver, such as a wrench or power tools. The driver is used to apply torque to and rotate the apparatus around an axis passing through the stepped regions of the shaft.

Preferably, the apparatus includes four stepped regions of decreasing cross-sectional dimensions. The two largest cross-sectional regions define the drive portion that is engaged by the driver. The two smaller cross-sectional regions, or engagement regions, define an engagement portion. The cross-sections of the engagement regions are substantially square and defined by four substantially parallel edges extending over the length of the engagement regions parallel to the rotational axis of the shaft.

In the method of invention, the apparatus is used to remove a broken threaded member from a tapped hole. A bore is produced in the member having a plurality of cross-sectional dimensions which are less than at least one cross-sectional dimension of a corresponding region on the apparatus. The apparatus is inserted into the bore so that at least one edge on the apparatus cuts into the member in the plurality of bore cross-sections. The driver is used to apply torque to the apparatus which transmits the torque to the member to unthread the member from the tapped hole.

The apparatus provides for increased reliability in the removal of broken members, such as fasteners, from tapped holes. The apparatus provides for substantially increased contact lengths with the member, which reduces the force that must be transmitted through the contact area. In addition, the generally tapered shape of the apparatus and bore provides a mechanical advantage by providing three dimensional translation of the applied torque into the member. The apparatuses and methods are particularly useful for the removal of broken sensor bodies from equipment, because the reduced possibility of stripping the bore, as commonly occurs when using prior art devices on soft materials.

Accordingly, the apparatuses and methods of the present invention provide for increased reliability and performance in the removal of broken threaded members, such as bolts and other fasteners from tapped holes. The above advantages and others will become apparent from the following detailed description.

BRIEF DESCRIPTION OF THE DRAWINGS

Preferred embodiments of the invention will now be described, by way of example only, with reference to the accompanying Figures wherein like members bear like reference numerals and wherein:

FIG. 4(*b*) depicts a broken threaded member in a surface containing a bore having a first cross-sectional dimension;

FIG. 4(*c*) depicts a bore in a broken threaded member having two stepped regions having first and second dimensions connected by a tapered step;

FIG. 4(*d*) depicts a partial insertion of a preferred embodiment of the present invention into the broken threaded member of FIG. 4(*c*);

FIG. 4(*e*) depicts full insertion of a preferred embodiment of the present invention into the broken threaded member of FIG. 4(*c*); and, FIG. 4(*f*) depicts the removal of the threaded member from the tapped hole by the application of torque to the apparatus.

DETAILED DESCRIPTION OF THE INVENTION

Figure 1:
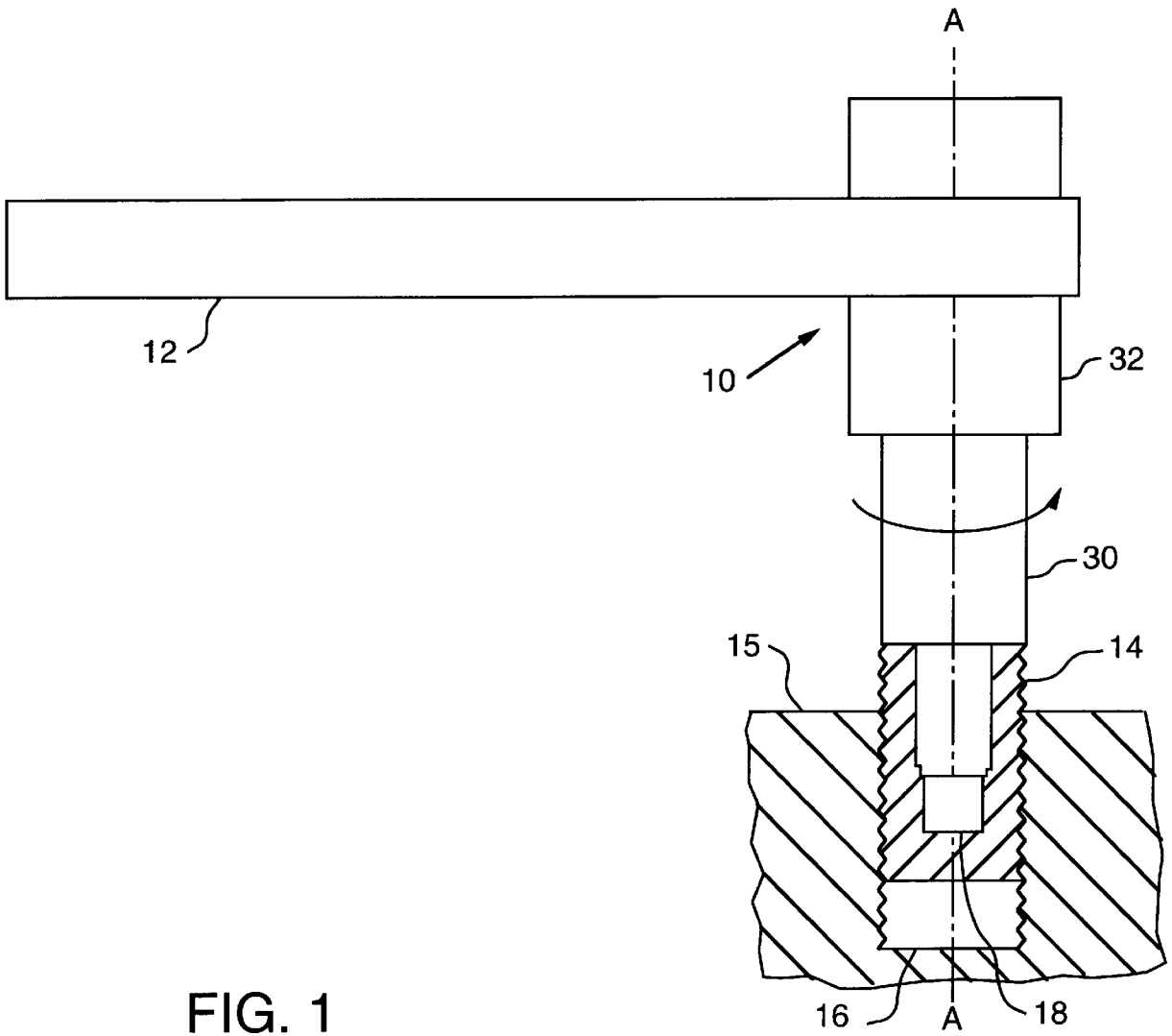
FIG. 1 shows an apparatus of the present invention being used in conjunction with a driver to remove a broken threaded member from a tapped hole.

The operation of the apparatus 10 will be described generally with reference to the drawings for the purpose of illustrating the present preferred embodiments of the invention only and not for purposes of limiting the same. As shown in FIG. 1, the apparatus 10 is generally used in combination with a driver 12, such as a wrench or a power tool, to remove a broken threaded member 14 from a tapped hole 16 in a surface 15. The apparatus 10 is inserted into a bore 18 extending from a broken end 19 of the threaded member 14 and the driver 12 is used to apply a torque to the apparatus 10 and rotate it around an axis of rotation A—A. The apparatus 10 translates the torque into the threaded member 14 to rotate and unthread the member 14 from the tapped hole 16.

The apparatus 10 is generally a shaft-like member, or tool, that includes an engagement portion 20 and a drive portion 22. The engagement portion 20 includes a plurality of engagement regions having decreasing cross-sectional dimensions relative to an axis of rotation A—A passing through the engagement regions and the drive portion 22 of the shaft. The cross-sectional dimensions of the engagement regions generally correspond to the dimensions of the bore 18. The engagement regions are used to transmit torque to member 14, preferably over the entire length of engagement portion 20 in the bore 18.

The engagement portion 20 and the drive portion 22 are preferably tapered or stepped to provide a continuously decreasing cross-sectional dimension from the drive portion 22 through the engagement portion 20. In a preferred embodiment, the apparatus 10 has a continuously, or a step-wise continuously, decreasing cross-section that mates with the bore 18 having a correspondingly decreasing diameter. The changing dimensions of the apparatus 10 provide for three dimensional transfer of torque from the drive portion 22, which preferably has the largest cross-sectional dimension, to the engagement regions in contact with the member 14. The tapered shape of the apparatus 10 provides a mechanical advantage when used in combination with a correspondingly shaped bore over devices of the prior art.

One skilled in the art will appreciate that the cross-sectional dimensions of the apparatus 10 can be varied to affect the transfer of torque within the apparatus 10 and to vary the location of the maximum shear stress. For example, if a region in the drive portion 22 has a cross-sectional dimension relative to the axis of rotation A—A that is smaller than the cross-sectional dimensions of adjacent regions, stress will unnecessarily be concentrated in the smaller dimensioned region. Whereas, if a region in the drive portion 22 has a substantially larger cross-sectional dimension than an adjacent region toward the engagement portion, stress will unnecessarily concentrate in the adjacent region due to the size mismatch.

In a preferred embodiment, the apparatus 10 includes two stepped engagement regions, 24 and 26, respectively, that correspond to two stepped sections, 24'and 26', in the bore 18. In addition, a tapered, or chamfered, step 25 is provided between the stepped regions, 24 and 26. In practice, the stepped sections, 24'and 26', of the bore 18 are typically produced by successive boring of the member 14 from the broken end 19, but can be produced by other methods and in any order. The boring is generally performed using a drill having a standard tapered drill bit tip that will also provide a tapered, or chamfered, step between the sections, 24'and 26', in the bore 18.

In addition to varying the number and height of steps in the engagement portion 20, another alternative embodiment is to provide a smoothly tapered, i.e., continuously decreasing cross-sectional dimension, apparatus 10 that is used with a corresponding smoothly tapered bore 18. A tapered drill bit or other tapered reaming device may be necessary to produce a smoothly tapered bore 18 for use with the smoothly tapered embodiment of the apparatus 10.

The drive portion 22 should extend beyond the surface 15, when the apparatus 10 is fully inserted into the bore 18 to provide for engagement by the driver 12. The drive portion 22 generally includes a drive head 28 suitable for engagement by the driver 12. The driver 12 is used to apply torque to the apparatus 10 via the drive head 28. The drive head 28 is preferably hexagonally shaped so that it can be engaged using common socket tools, such as wrenches, ratchets, and power tools.

Preferably, the drive portion 22 includes at least one drive region having a cross-sectional dimension greater than the engagement portion 20. Alternatively, the drive portion 22 may have cross-sectional dimensions that are smaller than or the same as the engagement region immediately adjacent to the drive portion 22.

In a preferred embodiment, the drive portion 22 includes a third and fourth stepped region, 30 and 32, respectively, having respectively increasing dimensions that provide for consecutively, or step-wise continuously, decreasing cross-sectional dimensions from the drive portion 22 through the engagement portion 20, as shown in the figures.

The engagement portion 20 includes at least one engagement edge 34 extending over at least a portion of the engagement regions, 24 and 26. Preferably, the engagement edge 34 extends over the entire engagement portion 20 through each engagement region and in a direction having a component parallel to the axis of rotation A—A of the apparatus 10. The engagement edge 34 is sharpened and is used to cut into, grip and transmit torque to the member 14, when the apparatus 10 is inserted in the bore 18. A continuous engagement edge 34 through the engagement portion 20 is preferred to increase the contact area between the apparatus 10 and the member 14.

The number of engagement edges 34 used in the invention should balance the objectives of maximizing the contact area between the engagement edges 34 and the member 14, while maintaining the structural integrity of the member 14 and preventing additional deformation of the member 14 in the tapped hole 16.

Figure 3:
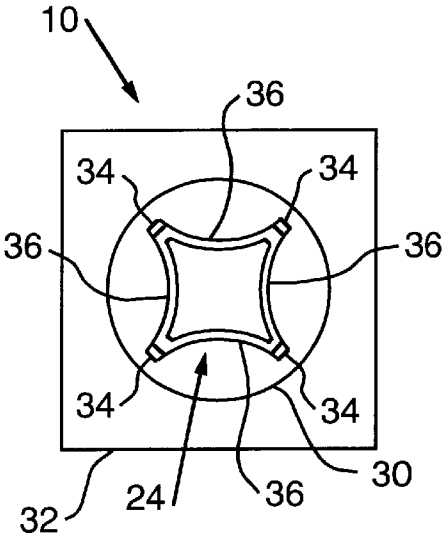
FIG. 3 is an end view of a preferred embodiment of the present invention.
Figure 2:
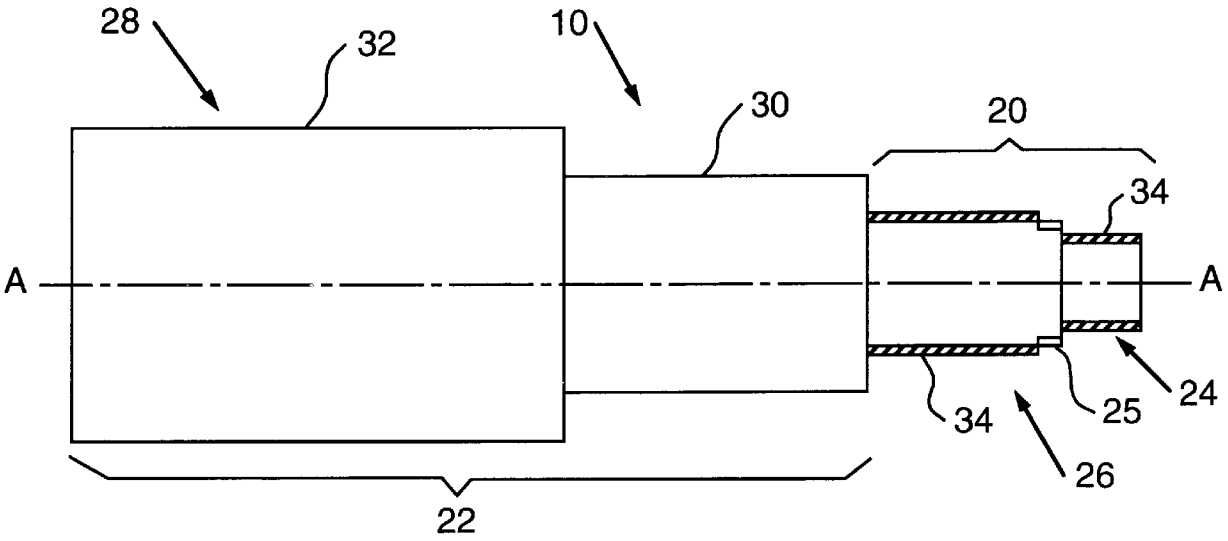
FIG. 2 is a side view of a preferred embodiment of the present invention.
Figure 4A:
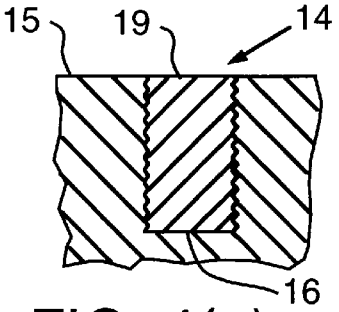
FIG. 4(*a*) depicts a broken threaded member in a surface.
Figure 4B:
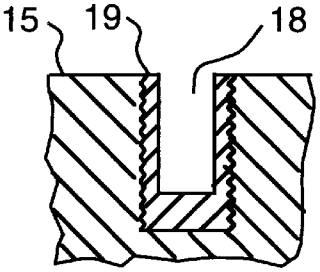
Figure 4C:
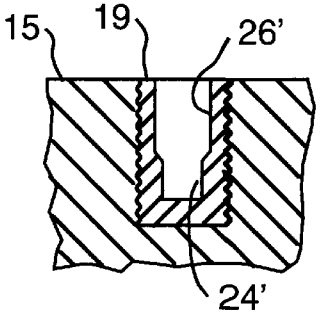
Figure 4D:
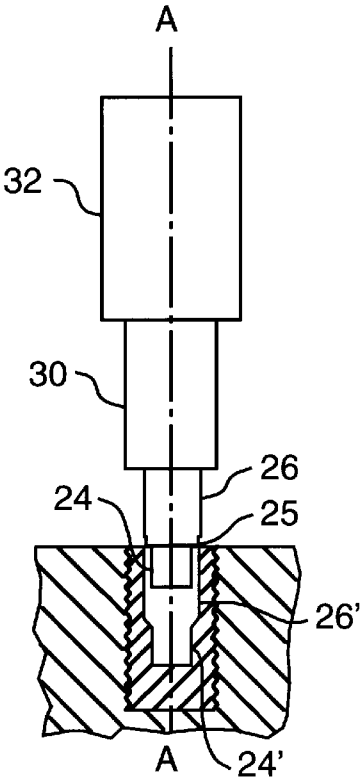
Figure 4E:
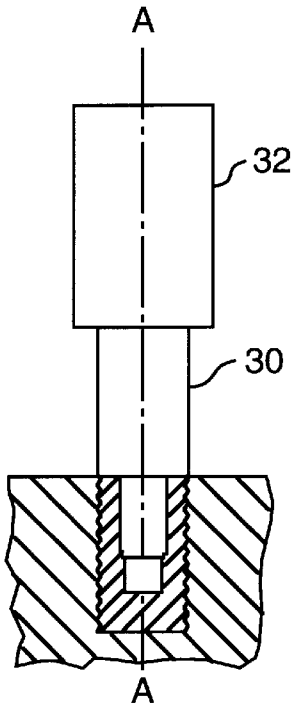
Figure 4F:
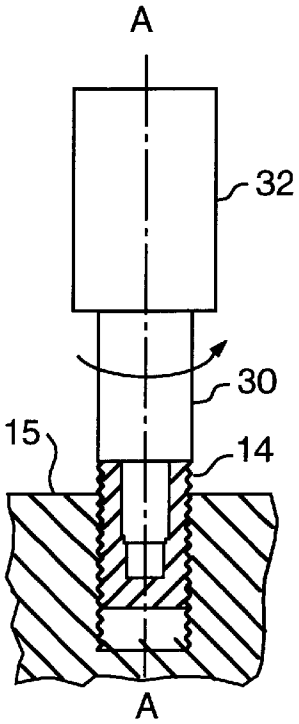

In a preferred embodiment, shown in FIGS. 2 and 3, for use in a circular cross section bore 18, four continuous engagement edges 34 extend the length of the engagement portion 20 parallel to the axis of rotation A—A. The engagement edges 34 define a substantially square cross-section perpendicular to the rotational axis A—A. The engagement regions, 24 and 26, are preferably scalloped 36 between the engagement edges 34 to accentuate the edges 34. The four engagement edges 34 collectively spanning the two engagement regions, 24 and 26, and step 25 provide a total of twelve different engagement surfaces in contact with the member 14.

Alternatively, any suitable number of engagement edges 34 and cross-sectional shapes can be used for the engagement portion 22 keeping view of the above-mentioned considerations. Also, the engagement edges 34 can be fluted or threaded to vary the engagement of the apparatus 10 with the member 14. One skilled in the art will appreciate that the cross-sectional shape and the design and number of engagement edges 34 can be varied to practice the invention for different bore sizes and geometries.

A method of using the apparatus 10 of the present invention will be described with respect to removing a broken threaded member 14, such as a bolt, the steps of which are schematically shown in FIGS. 4(*a–f*). A cut away view of a broken solid shaft fastener is shown in FIG. 4(*a*). Initially, a bore is drilled from the broken end 19 of the member 14 into the member 14 substantially parallel to and preferentially axisymmetric with, the axis of rotation A—A. As shown in FIG. 4(*b*), the shaft then contains a bore having a first cross-sectional dimension, which in the case of a drilled out bore or a tubular shaft will be a first diameter. If the apparatus 10 is used to remove a tubular shaft, such as a sensor body, the shaft will resemble FIG. 4(*b*) before the start of the removal operation.

As shown in FIG. 4(*c*), the bore 18 is widened starting from the broken end 19 of the member 14 to provide for consecutively decreasing cross-section dimensions extending into the bore 18 from the broken end 19. In a preferred embodiment, the bore 18 is widened by drilling out the bore 18 to a second diameter using a drill bit having a tapered tip to provide a tapered step between stepped sections, 24'and 26', having first and second diameters, respectively. In FIG. 4(*d*), the apparatus 10 is shown being inserted into the bore 18 until the edge of the stepped region 26 engages the broken end 19 of the member 14. The apparatus 10 is inserted the remaining distance into the bore (FIG. 4 (*e*)) either by the application of force (i.e., hammering), when the engagement edges 34 are not threaded, or by the application of torque, if engagement edges 34 are threaded. A torque is then applied to the apparatus 10 to unthread the member 14 from the tapped hole 16, as shown in FIG. 4(*f*).

The present invention is particularly useful for the removal of broken sensor bodies, such as thermocouples, from equipment. Sensor bodies are typically composed of materials that are softer than bolts or other threaded fasteners that are subject to stress. The softer sensor body materials, such as brass, are more difficult to remove using prior art easy-out devices, because the application of torque near the rim of the broken fastener causes the soft material to yield and the easy-out "strips" the bore.

Because the present invention cuts into the fastener, the soft material can be easily penetrated by the engagement edges 34 to provide solid contact between the apparatus 10 and the member 14. Also, the apparatus 10 can be easily tapped into full contact along the length of the bore 18 to substantially increase the surface area over which the torque is applied. The increased contact area greatly reduces the force that must be transmitted through the contact area and the resulting potential for stripping of the bore by the apparatus 10. These advantages facilitate the easy removal of the sensor body from the equipment using the apparatuses and methods of the present invention.

Those of ordinary skill in the art will appreciate that a number of modifications and variations that can be made to specific aspects of the method and apparatus of the present invention without departing from the scope of the present invention. Such modifications and variations are intended to be covered by the foregoing specification and the following claims.

What is claimed is:

1. A method of removing a broken threaded member from a tapped hole, the member having a broken end and an outer diameter, said method comprising:

producing a bore having a plurality of bore cross-sections extending from the broken end into the member; and, engaging the member in a plurality of the bore cross-sections to transmit torque to unthread the member from the tapped hole.

2. The method of claim 1, wherein said engaging comprises, providing a tool having regions corresponding to the plurality of bore sections and including at least one engagement edge that provides for at least one cross-sectional dimension that is larger than the corresponding bore cross-sectional dimensions and less than the outer diameter of the member;

inserting the tool into the bore to cut into the member with the at least one engagement edge; and, rotating the tool about an axis to transmit torque to unthread the member from the tapped hole.

3. A method of removing a broken threaded member from a tapped hole, the member having a broken end and an outer diameter, said method comprising:

producing a bore having a plurality of cross-sectional dimensions extending from the broken end into the member;

providing a tool having regions corresponding to the plurality of bore dimensions and including at least one engagement edge that provides for at least one cross-sectional dimension that is larger than the corresponding bore dimensions and less than the outer diameter of the member;

inserting the tool into the bore to cut into the member with the at least one engagement edge; and, rotating the tool about an axis to transmit torque to unthread the member from the tapped hole.

4. The method of claim 3, wherein:

said producing further comprises producing a bore having a plurality of cross-sections of decreasing dimensions extending from the broken end into the member; and, said providing further comprises providing the tool with a plurality of stepped regions of decreasing cross-sectional dimensions.

5. The method of claim 4, wherein:

said producing further comprises producing a bore having a plurality of cross-sections of decreasing diameter extending from the broken end into the member; and, said providing further comprises providing the tool with a plurality of stepped regions of decreasing diameter.

6. The method of claim 4, wherein said providing further comprises providing the tool with tapered steps between the stepped regions.

7. The method of claim 4, wherein said providing further comprises providing the tool with four substantially parallel engagement edges extending completely over each region and spaced to provide a substantially square cross-section.

8. The method of claim 3, wherein said inserting includes forcing the tool into the bore.

9. The method of claim 8, wherein said forcing includes hammering the tool into the bore.

10. The method of claim 8, wherein said providing includes providing a tool having a plurality of engagement edges extending parallel to the axis about which the tool is rotated.

11. The method of claim 8, wherein said providing includes providing a tool having at least one sharpened engagement edge.

12. The method of claim 8, wherein said inserting includes inserting the tool into the bore by applying torque to the tool.

13. The method of claim 3, wherein said providing includes providing a tool that includes a drive portion attached to at least one of the regions corresponding to the plurality of bore dimensions and said rotating includes applying torque to the drive portion.

14. The method of claim 13, further comprising engaging the drive portion with a driver.

15. The method of claim 3, wherein said providing further comprises providing the tool with an engagement edge extending entirely over the regions corresponding to the plurality of bore dimensions.

16. The method of claim 3, wherein said producing further comprises producing a bore with tapered steps between the cross-sectional dimensions of the bore.

17. The method of claim 16, wherein said producing a bore with tapered steps between the cross-sectional dimensions of the bore further comprises drilling the bore using a drill bit having a tapered tip.

18. A method of removing a broken threaded member from a tapped hole, the member having a broken end and an outer diameter and containing a bore having a first diameter extending from the broken end into the member, said method comprising:

widening a segment of the bore adjacent to the broken end of the member to a second diameter;

providing a tool having two regions corresponding to the first and second diameters, each region including at least one engagement edge that provides a cross-sectional dimension that is larger than the corresponding first and second diameters and less than the outer diameter of the member;

inserting the tool into the bore to cut into a portion of the member corresponding to the first and second diameter of the bore with the at least one engagement edge on the corresponding regions; and, rotating the tool about an axis to transmit a torque to unthread the member from the tapped hole.

19. The method of claim 18, wherein said providing further comprises providing the tool with four engagement edges extending completely over each region and spaced to provide a substantially square cross-section.

20. A method of removing a broken threaded member from a tapped hole, the member having a broken end and an outer diameter, said method comprising:

producing a bore having a first diameter extending from the broken end into the member;

widening a segment of the bore adjacent to the broken end of the member to a second diameter;

providing a tool having regions corresponding to the first and second diameters, each region including at least one engagement edge that provides a cross-sectional dimension that is larger than the corresponding first and second diameters and less than the outer diameter of the member;

inserting the tool into the bore to cut into a portion of the member corresponding to the first and second diameter of the bore with the at least one engagement edge on the corresponding regions; and, rotating the tool about an axis to unthread the member from the tapped hole.

21. A method of removing a broken threaded member from a tapped hole, the member having a broken end and an outer diameter, said method comprising:

producing a bore having a plurality of cross-sectional dimensions of decreasing diameter extending from the broken end into the member;

providing a tool having regions corresponding to the plurality of diameters, each region including at least one engagement edge that provides for at least one cross-sectional dimension that is larger than the corresponding diameters and less than the outer diameter of the member;

inserting the tool into the bore to cut into a portion of the corresponding diameter of the member with the at least one engagement edge on the corresponding regions; and, rotating the tool about an axis to transmit a torque to unthread the member from the tapped hole.

22. The method of claim 21, wherein said inserting includes forcing the tool into the bore.

23. The method of claim 22, wherein said forcing includes hammering the tool into the bore.

24. The method of claim 22, wherein said providing includes providing a tool having a plurality of engagement edges extending parallel to the axis about which the tool is rotated.

25. The method of claim 22, wherein said providing includes providing a tool having at least one sharpened engagement edge.

26. The method of claim 21, wherein said inserting includes inserting the tool into the bore by applying torque to the tool.

27. The method of claim 21, wherein said providing includes providing a tool that includes a drive portion attached to at least one of the regions corresponding to the plurality of bore dimensions and said rotating includes applying torque to the drive portion.

28. The method of claim 27, further comprising engaging the drive portion with a driver.

29. The method of claim 21, wherein said providing further comprises providing the tool with an engagement edge extending entirely over the regions corresponding to the plurality of bore dimensions.

30. The method of claim 21, wherein said producing further comprises producing a bore with tapered steps between the cross-sectional dimensions of the bore.

31. The method of claims 30, wherein said producing a bore with tapered steps between the cross-sectional dimensions of the bore further comprises drilling the bore using a drill bit having a tapered tip.

* * * * *